US007775855B2

(12) United States Patent
Cybulski et al.

(10) Patent No.: US 7,775,855 B2
(45) Date of Patent: Aug. 17, 2010

(54) SANDING TOOL WITH ROTATABLE HANDLE

(75) Inventors: Eric R. Cybulski, Woodbury, MN (US); Ryan Patrick Simmers, Cottage Grove, MN (US); Jon A. Kirschhoffer, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/275,396

(22) Filed: Dec. 29, 2005

(65) Prior Publication Data

US 2007/0155297 A1 Jul. 5, 2007

(51) Int. Cl.
*B24B 1/00* (2006.01)
*B24B 23/00* (2006.01)

(52) U.S. Cl. ..... 451/28; 451/59; 451/344; 451/354; 451/524

(58) Field of Classification Search ..... 451/502, 451/519, 523, 524, 520, 344, 354, 356, 499, 451/503, 514, 28, 59, 525
See application file for complete search history.

(56) References Cited

U.S. PATENT DOCUMENTS

| | | | | |
|---|---|---|---|---|
| 227,438 | A | 5/1880 | Lothrop | |
| 872,568 | A | 12/1907 | Linderoth | |
| 952,186 | A | 3/1910 | Courtois | |
| 3,273,192 | A | 9/1966 | Mazzella | |
| 5,168,672 | A | 12/1992 | Grégoire, Sr. | |
| 5,527,212 | A | 6/1996 | Bowen et al. | |
| 5,709,596 | A | 1/1998 | Alexander et al. | |
| 5,718,622 | A | 2/1998 | Jones | |
| 5,863,243 | A * | 1/1999 | Ali | 451/503 |
| 6,266,850 | B1 | 7/2001 | Williams et al. | |
| 6,347,985 | B1 | 2/2002 | Loveless | |
| 6,379,237 | B1 * | 4/2002 | Gordon | 451/523 |
| 6,413,157 | B1 | 7/2002 | Marton | |
| 6,454,643 | B1 | 9/2002 | Bode | |
| 6,524,175 | B2 | 2/2003 | Beaudry et al. | |
| 6,613,113 | B2 | 9/2003 | Minick et al. | |

(Continued)

FOREIGN PATENT DOCUMENTS

| | | |
|---|---|---|
| FR | 988 686 | 8/1951 |

(Continued)

OTHER PUBLICATIONS

U.S. Appl. No. 11/117,932; Inventors: Kirschhoffer, Jon A.; Cybulski, Eric R.; Simmers, Ryan Patrick; and Gonzalez, Bernard A.; filed Apr. 29, 2005; Total No. of pages: 16; and Total No. of sheets of Drawings: 5.

*Primary Examiner*—Eileen P. Morgan
(74) *Attorney, Agent, or Firm*—David B. Patchett

(57) ABSTRACT

A hand-held, manually-operated sanding tool includes a base body, a handle, and a coupling device. The base body defines an aperture extending from a first surface of the base body to a second surface of the base body. The handle includes a grip and a post. The coupling device is coupled with the post of the handle through the aperture. The handle and the coupling device are positioned near opposite surfaces of the base body to rotatably couple the handle to the base body such that the handle is rotatable about an axis defined by the post.

6 Claims, 8 Drawing Sheets

U.S. PATENT DOCUMENTS

| | | | | |
|---|---|---|---|---|
| 6,634,937 | B1 * | 10/2003 | Edwards et al. | 451/502 |
| 7,094,137 | B2 * | 8/2006 | Ueno | 451/350 |
| 7,101,274 | B1 | 9/2006 | Etter et al. | |
| 7,182,681 | B2 | 2/2007 | Kirschhoffer et al. | |
| 2003/0085244 | A1 | 5/2003 | Parsons | |
| 2003/0104777 | A1 | 6/2003 | Deshler | |

FOREIGN PATENT DOCUMENTS

| | | |
|---|---|---|
| GB | 953 051 | 3/1964 |
| WO | WO 2005/068179 A1 | 7/2005 |

* cited by examiner

SANDING TOOL WITH ROTATABLE HANDLE

CROSS-REFERENCE TO RELATED APPLICATIONS

This application is related to U.S. patent application Ser. Nos. 11/117,982, filed Apr. 29, 2005, entitled "Sanding Tool;" Ser. No. 11/201,742, filed Aug. 11, 2005, entitled "Sanding Tool with Rotatable Handle;" Ser. No. 11/201,763, filed Aug. 11, 2005, entitled "Sanding Tool with Sheet Loading Feature;" Ser. No. 11/201,743, filed Aug. 11, 2005, entitled "Sanding Tool with Protective Clamping Mechanism;" and Ser. No. 11/275,390, filed on Dec. 29, 2005, now issued as U.S. Pat. No. 7,144,300, entitled "Sanding Tool With Clamping Mechanism," the teachings of all of which are incorporated herein by reference.

BACKGROUND

The present invention relates generally to a hand-held, manually-operated sanding tool for use with a replaceable sheet of abrasive material such as sandpaper. More particularly, it relates to sanding tools adapted to satisfy user handling preferences.

Abrasive sheets, such as conventional sandpaper, are commonly used to hand-sand or finish a work surface, such as a wooden surface. With hand-sanding, the user holds the sandpaper directly in his/her hand and then moves the sandpaper across the work surface. Sanding by hand can, of course, be an arduous task. To facilitate the hand-sanding process, the sandpaper can instead be retained by a sanding block or tool sized to fit within the user's hand. The sanding block or tool thus makes hand-sanding faster and easier. One example of a commercially-available sanding block is the 3M™ Rubber Sanding Block available from 3M Company of Saint Paul, Minn.

U.S. Pat. No. 5,168,672 describes another example of a sanding block or tool in the form of an abrasive sheet holder having a base provided with clamping shoulders formed in a pair of opposed side edges thereof. A handle is detachably secured over a rear surface of the base. The handle has opposed flexible flange walls for clamping opposed end edge portions of an abrasive paper sheet that is otherwise positioned over a front working surface of the base, with the edge portions of the paper sheet extending over the clamping shoulders. A grip portion of the handle promotes grasping thereof within a palm of the user's hand. The grip portion is spatially fixed relative to the base. Thus, the grip portion is also spatially fixed relative to the paper attached to the base.

Additionally, U.S. Patent Application Publication No. 2003/0104777 describes an example sanding block or tool including a generally rectangular base housing upon which a multi-contoured, generally convex hand-grip is secured. The hand-grip further defines inwardly extending concave portions that facilitate easy and secure grasping by the user. Further, an over-center lever clamp mechanism is operative at each end of the sanding block to secure the opposed ends of a sandpaper sheet in a releasable manner. The hand-grip is ergonomic in design, and is spatially fixed relative to the base (and thus relative to sandpaper secured to the base).

As highlighted by the above, while well-accepted, known sanding blocks may have certain shortcomings. For example, it is desirable that the sanding block promotes sanding in multiple directions such that the sheet of abrasive material will wear relatively evenly. This desired characteristic, in turn, means that most of the available abrasive material surface area is used before the sheet is discarded. Unfortunately, the spatially fixed handles associated with known sanding blocks do not satisfy this user preference. To the contrary, while the grip portion of known sanding block handles provide a "natural" directional orientation of the user's hand when grasping the grip portion, this directional orientation of the grip portion/user's hand relative to the abrasive material retained by the tool cannot be altered. This, in turn, dictates that sanding will primarily occur in only one or two sanding directions. In other words, the fixed grip portion promotes sanding in either an up-and-down direction or a left-to-right direction relative to the user's hand; these limited sanding directions may result in uneven wear of the abrasive material.

Further, the unidirectional configuration of the known sanding block grip portion may cause distinct user discomfort over periods of extended use, such as where the natural directional orientation is contrary to the user's desired hand orientation or where the user desires to sand in multiple different directions. These concerns arise with flexible flat sheets of abrasive material, such as conventional sandpaper, as well as with resilient flexible abrasive sheets that are thicker than conventional sandpaper, such as the sheet-like abrasive materials described in, for example, Minick et al., U.S. Pat. No. 6,613,113.

U.S. Pat. No. 6,524,175 describes a pole sanding tool having a head maintaining a layer of hook-and-loop fastening material for attachment to a corresponding surface of a sanding sponge. The pole sander head further includes a universal joint for receiving an end of an elongated pole. Though pole sanding tools represent a distinct field apart from that of hand-held sanding tools, the universal joint may facilitate "swiveling" of the pole relative to the head. However, because the pole itself does not include a discernable grip portion or desired grasping orientation, the universal joint does not address rotation of a grip portion relative to the head, nor does it "lock" the pole relative to the head at multiple rotational orientations.

In light of the above, a need exists for a hand-held sanding tool that is easy to consistently load with an abrasive sheet and that provides multiple rotational orientations of a handle relative to the retained abrasive sheet to enhance user comfort.

SUMMARY

One aspect of the present invention relates to a hand-held, manually-operated sanding tool including a base body, a handle, and a coupling device. The base body defines an aperture extending from a first surface of the base body to a second surface of the base body. The handle includes a grip and a post. The coupling device is coupled with the post of the handle through the aperture. The handle and the coupling device are positioned near opposite surfaces of the base body to rotatably couple the handle to the base body such that the handle is rotatable about an axis defined by the post.

DETAILED DESCRIPTION

Figure 1:
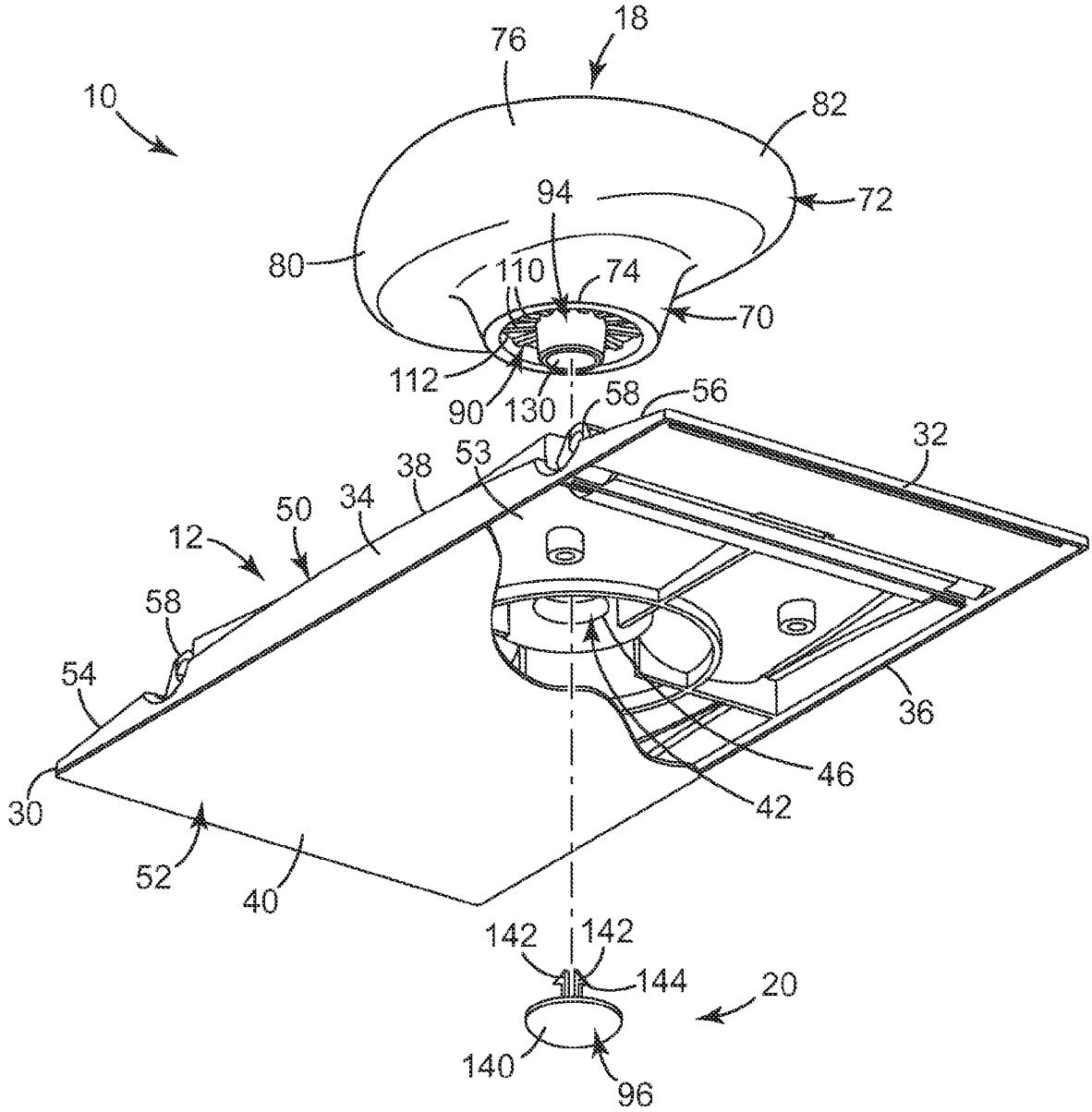
FIG. 1 is a bottom perspective, exploded view of a hand-held, manually-operated sanding tool according to principles of the present invention.
Figure 2:
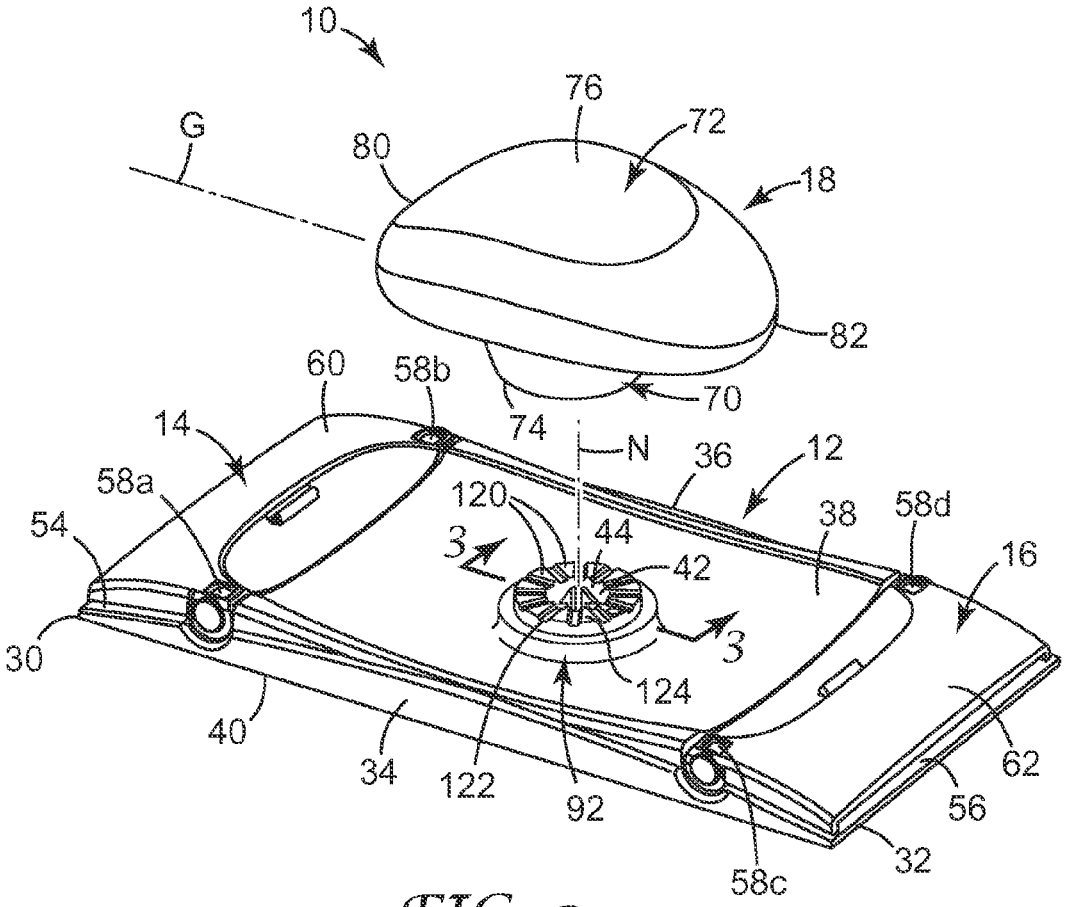
FIG. 2 is a top perspective, exploded view of the sanding tool of FIG. 1.

One embodiment of a hand-held, manually-operated sanding tool or sanding block 10 is shown in exploded form in FIGS. 1 and 2. The term "manually-operated" refers to the fact that the tool 10 is not a power tool. That is, all of the power for the tool 10 is provided by a user (not shown), and the tool 10 itself does not include a motor. It will be recognized, however, that principles of the present invention may be applied to a power tool and are not necessarily limited to manually-operated sanding tools.

The sanding tool 10 is described below as being useful with sheet-like abrasive material. As used throughout this specification, the terms "sheet-like abrasive material" and "sheet of abrasive material" are used interchangeably and refer to thin, flexible, generally square or rectangular sheets of abrasive material having discrete ends that can be attached to a sanding block. Such sheet-like abrasive materials include, for example, conventional sandpaper, flexible sanding scrims, non-woven abrasive materials such as Scotch-Brite™ available from 3M Company, St. Paul, Minn., and thin flexible abrasive sheet materials such as those described in U.S. Pat. No. 6,613,113 (Minick et al.), the entire contents of which are hereby incorporated by reference. The tool 10 may also find use with non-abrasive sheet-like materials such as dust removing tack cloths. However, the terms "sheet-like abrasive material" and "sheet of abrasive material" do not include so-called endless belts of abrasive material commonly used with power sanding tools, die cut sheets that are commonly sold pre-cut to match the size and shape of a particular sanding tool as is commonly done for power detail sanding tools, or abrasive sheets having their own attachment means, such as adhesive or hook-and-loop fasteners, that independently facilitate attachment to a tool.

With the above in mind, in one embodiment, the sanding tool 10 includes a base member 12, first and second clamping mechanisms 14, 16 (shown in FIG. 2), a handle 18, and a mounting assembly 20 (referenced generally in FIG. 1). For ease of illustration, the clamping mechanisms 14, 16 are not shown in FIG. 1. As made clear below, the base member 12 and the clamping mechanism(s) 14 and/or 16 can assume a wide variety of forms apart from that shown in FIGS. 1 and 2 in accordance with principles of the present invention. Regardless, and in general terms, the first and second clamping mechanisms 14, 16 are pivotally associated with opposing ends, respectively, of the base member 12. The handle 18 is rotatably coupled to the base member 12 by the mounting assembly 20. With this configuration, the handle 18 can be moved to a variety of different rotational orientations relative to the base member 12 as desired by a user.

In one embodiment, the base member 12 defines first and second opposed ends 30, 32, first and second opposed sides 34, 36, a top surface 38, and a generally planar bottom surface 40 against which a sheet of abrasive material (not shown) is secured. While the base member 12 is illustrated in FIG. 1 as having a generally rectangular shape, a variety of other shapes can be provided that lend themselves for use with conventional sheet-like abrasive materials. For example, the base member 12 can be configured such that one or both of the first and second ends 30, 32 define a triangular or curved shape. Further, the first and second ends 30, 32 need not be identical in shape.

Figure 3:
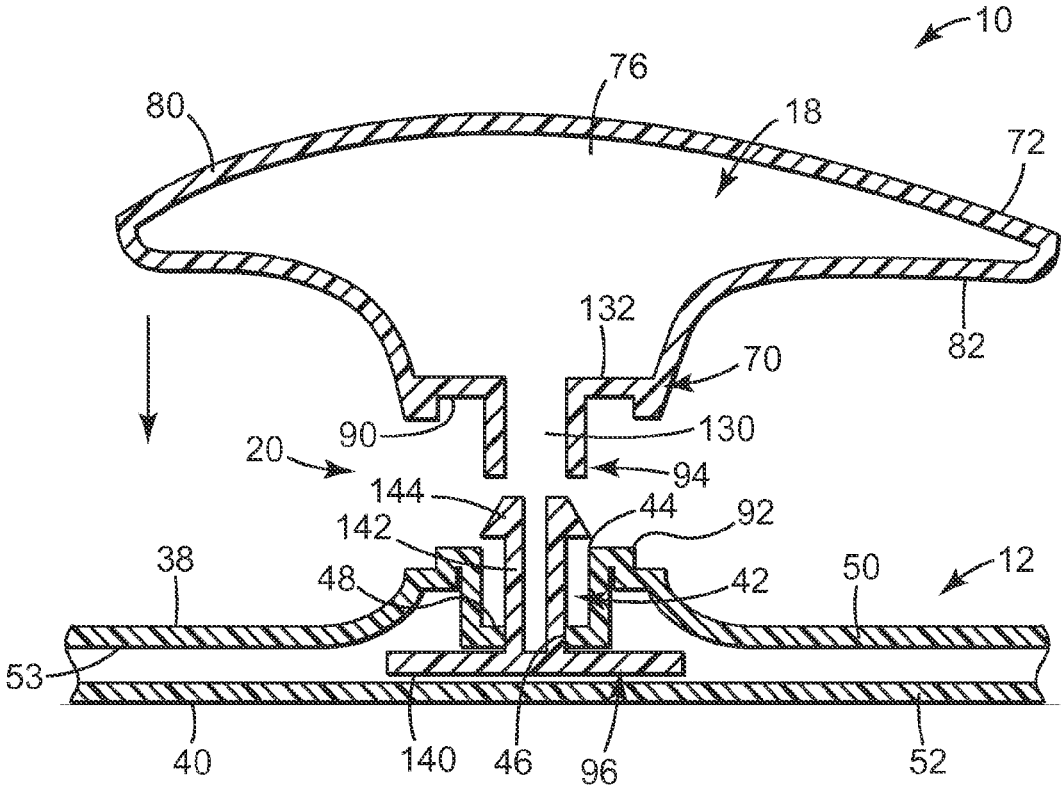
FIG. 3 is a cross-sectional view of one embodiment of the sanding tool of FIG. 2 taken along the line 3-3.

As described below, the base member 12 is, in one embodiment, adapted to form a portion of the mounting mechanism 20. In more general terms, however, the base member 12 forms a cavity 42 adapted to facilitate assembly to the handle 18 (as shown in FIG. 2). With reference to FIGS. 1 and 2, the cavity 42 extends from, and is open relative to, the top surface 38, so as to be defined by a cavity opening 44 at the top surface 38. In one embodiment, the cavity 42 terminates in an aperture 46 opposite the cavity opening 44, with the opening 44 and the aperture 46 being coaxially centered relative to one another. In this regard, and as best shown in FIG. 3, the base member 12 includes or forms a shoulder 48 that otherwise defines the aperture 46, with the shoulder 48 extending substantially parallel to the general plane of the top surface 38. In one embodiment, the shoulder 48 forms the aperture 46 to have a smaller diameter than that of the opening 46 to facilitate capturing of a component of the mounting assembly 20 as described below. Alternatively, however, construction of the mounting assembly 20 can assume a variety of other forms, such that the aperture 46 can be larger than, or have the same size as, the opening 44 and/or the shoulder 48 can be eliminated.

Depending upon an exact construction of the base member 12, the cavity 42 can also extend to and/or through the bottom surface 40. However, as best shown in FIG. 1, in one embodiment the base member 12 is formed by a base body 50 and a support body 52. The base body 50 defines the top surface 38, the entire cavity 42, and an internal surface 53 opposite the top surface 38. In one embodiment, the support body 52 is separately formed and assembled to the base body 50, more specifically, to the internal surface 53. In one embodiment, the support body 52 includes a foam pad or other material amenable for supporting a sheet-like abrasive material (not shown). Regardless, the support body 52 defines the bottom surface 40 and extends across the cavity 42, such that the cavity 42 is covered relative to the bottom surface 40 with the one embodiment of FIG. 1.

In one embodiment, regardless of an overall shape, the top surface 38 forms a first upper contact surface 54 (referenced generally) opposite the bottom surface 40 and extending from the first end 30. A second upper contact surface 56 (referenced generally) is similarly formed opposite the bottom surface 40, extending from the second end 32. In one embodiment, the upper contact surfaces 54, 56 are angled or inclined. In this manner, the upper contact surfaces 54, 56 and the bottom surface 40 form an acute angle relative to the associated end 30, 32, respectively. Alternatively, the first and/or second contact surfaces 54 and/or 56 need not be identical and need not necessarily be angled or inclined relative to the bottom surface 40.

In one embodiment, the base member 12 is configured to facilitate pivoting attachment thereto by the first and second clamping mechanisms 14, 16 as shown in FIG. 2. For example, the base member 12 forms posts 58*a*-58*d* as extensions from the top surface 38 adjacent the first contact surface 54 and the second contact surface 56, respectively. The posts 58*a*-58*d* are configured to receive a corresponding component associated with the first and second clamping mechanisms 14, 16 in a manner allowing for pivoting movement of the clamping mechanisms 14, 16 relative to the corresponding posts 58*a*, 58*b* and 58*c*, 58*d*. A wide variety of other structure(s) and/or mechanisms can be provided for pivotally connecting the clamping mechanisms 14, 16 to the base member 12. Even further, where the clamping mechanisms 14, 16 are of a conventional form, the posts 58 can be eliminated.

The first and second clamping mechanisms 14, 16 can also assume a wide variety of forms. In one embodiment, the clamping mechanisms 14, 16 include a pivoting member 60, 62, respectively, each maintaining a gripping surface (not shown). Details on acceptable constructions of the clamping mechanisms 14, 16 are provided, for example, in U.S. patent application Ser. No. 11/117,932, filed Apr. 29, 2005 and entitled "Sanding Tool", the teachings of which are incorporated herein by reference in its entirety. In general terms, the pivoting members 60, 62 are each pivotally secured to the base member 12 (such as via the posts 58*a*-58*d*) so as to be moveable between a closed position (illustrated in FIG. 2) and an open position in which the pivoting member 60, 62, and thus the gripping surface, is pivoted away from the corresponding upper contact surface 54, 56 to establish a gap in which a sheet-like abrasive material (not shown) is received. Subsequently, in the closed position, the clamping mechanism 14, 16 frictionally secures the sheet-like abrasive material to the corresponding upper contact surface 54, 56. With this one construction, a desired tension is readily established across the sheet-like abrasive material that otherwise extends along the bottom surface 40. Alternatively, one or both of the first and/or second clamping mechanisms 14 and/or 16 can be replaced with a conventional mechanism for securing a sheet of abrasive material (not shown) to the tool 10.

With reference to FIGS. 1 and 2, the handle 18 can also assume a variety of forms, and generally includes a neck 70 and a grip 72. The neck 70 forms a leading end 74, with the grip 72 extending from the neck 70 opposite the leading end 74. The grip 72 is configured to form a grip surface 76 adapted to facilitate ergonomic grasping thereof within a user's hand (not shown). For example, with the one embodiment of FIGS. 1 and 2, the grip surface 76 has a contoured, elongated ball-like shape that readily nests within the palm of a human hand. This elongated configuration can be defined by a number of different shapes, and generally includes a leading side 80 and a trailing side 82. The grip surface 76 tapers in width from the leading side 80 to the trailing side 82 to define a natural grasping orientation in which a user's thumb and index finger (not shown) naturally reside at the leading side 80, and the user's palm (not shown) rests on or at the trailing side 82. Of course, a user may prefer to hold the grip surface 76 in a number of different manners and the grip 72 can assume a wide variety of differing shapes. Regardless, and as best shown in FIG. 2, the grip surface 76 generally defines a gripping direction having an axis G; again, the gripping direction/axis G relates to an expected orientation of the user's hand while naturally grasping the grip surface 76 in a fashion encouraged by a shape of the grip surface 76.

Notably, the gripping direction/axis G is defined apart from the neck 70. That is to say, the neck 70 generally extends from the grip 72 in a direction displaced from the gripping direction/axis G for reasons made clear below. To this end, extension of the neck 70 defines a central neck axis N (FIG. 2) that is not otherwise aligned with the gripping direction/axis G. In one embodiment, the neck axis N and the gripping direction/axis G are substantially perpendicular to one another.

The mounting assembly 20 includes, in one embodiment, a first set of ridges 90 (FIG. 1), a second sent of ridges 92 (FIG. 2), a post 94 (FIG. 1), and a coupling device 96 (best shown in FIG. 1). Details on the various components are provided below with reference to FIGS. 1-3. In general terms, however, the first set of ridges 90 are associated with the handle 18, whereas the second set of ridges 92 are associated with the base member 12, more particularly, with the base body 50. The handle 18 is coupled with the base member 12 such that the first and second sets of ridges 90, 92 engage one another. In one embodiment, the post 94 extends from the neck 70 of the handle 18. The coupling device 96 extends through the cavity 42 to coaxially retain the post 94 to, thereby, maintain the base body 50 of the base member 12 therebetween. With this construction, the mounting assembly 20 allows for rotation of the handle 18 relative to the base member 12 and provides for a plurality of rotational orientation positions in which the handle 18 is substantially locked relative to the base member 12.

The first and second sets of ridges 90, 92 are correspondingly constructed to mesh with one another upon final assembly. With this in mind, in one embodiment, the first set of ridges 90 is integrally formed at the leading end 74 of the neck 70 around post 94, and includes a plurality of circumferentially arranged ridges 110, adjacent ones of which are separated by a gap 112 (one of which is identified in FIG. 1). Each of the ridges 110 has an approximately identical height, such that each of the gaps 112 defines an approximately identical depth. Further, in one embodiment, the ridges 110 are uniformly spaced. Any number of the ridges 110 can be provided; in one embodiment, however, at least four of the ridges 110 are formed, more preferably at least eight of the ridges 110 are formed, even more preferably at least ten.

With specific reference to FIG. 2, the second set of ridges 92 is, in one embodiment, integrally formed by the base member 12 at the top surface 38 thereof. The second set of ridges 92 includes a plurality of ridges 120 circumferentially arranged around the cavity 42, with adjacent ones of the ridges 120 being separated by a groove 122 (one of which is identified in FIG. 2). Each of the ridges 120 has an approximately identical height, such that each of the grooves 122 has an approximately identical depth. As compared to a nominal height of the ridges 110 of the first set 90, however, the ridges 120 of the second set 92 have an increased nominal height. Thus, a nominal depth of the grooves 122 is greater than a nominal height of the ridges 110. Further, each of the grooves 122 has a width slightly greater than a nominal width of the ridges 110. With this one embodiment then, upon final assembly, each of the ridges 120 of the second set 92 fully nest within a corresponding one of the gaps 112, whereas each of the ridges 110 of the first set 90 only partially extend or nest within a corresponding one of the grooves 122. In one embodiment, to facilitate selective disengagement of the ridges 120 from the gaps 112, the ridges 120 terminate in a slightly tapering end 124 (referenced generally in FIG. 2).

The post 94 is, in one embodiment, formed as an extension from the neck 70 in a direction of the neck axis N (FIG. 2). Referring to FIG. 3, the post 94 is sized to be coaxially received within the base member cavity 42 through the opening 44. The post 94 serves to generally align the handle 18 relative to the base member 12.

In one embodiment, the post 94 is substantially cylindrical and hollow to define a cavity 130 therein configured to receive a portion of the coupling device 96. An internal portion of the neck 70 extending around and radially outward from the cavity 130 defines a shoulder 132. In one embodiment, the shoulder 132 is formed opposite the first set of ridges 90. Alternatively, the post 94 can assume a variety of other forms, and in some embodiments is eliminated.

In one embodiment, the coupling device 96 is a pin as illustrated in FIGS. 1 and 3 and including a plate member 140 and two prongs 142 each extending in a first direction from the plate member 140. Plate member 140 is substantially planar and may be formed of any suitable shape, such as a circle, square, triangle, octagon, irregular shape, etc. The prongs 142 are spaced from one another and collectively are substantially centered relative to the plate member 140. Each of the prongs 142 are each at least partially deformable toward the other prong 142, but are biased to extend from plate member 140 in a substantially perpendicular manner as will be further described below. In one embodiment, each prong 142 defines a tooth 144 opposite the plate member 140. Each tooth 144 extends from the respective prong 142 in a direction substantially opposite the other one of the prongs 142.

Assembly of the handle 18 to the base member 12 via the mounting assembly 20 in accordance with one embodiment is substantially as follows. The neck 70 is positioned over the base member 12, as generally illustrated in FIG. 3, such that the post 94 aligns with the cavity opening 44. The handle 18 is moved toward the base member 12 as generally indicated by the arrow in FIG. 3 to position the post 94 at least partially within the cavity 42. When the post 94 is positioned within the cavity 42, the first and second sets of ridges 90, 92 interface (e.g., mesh) with one another as described above. The pin 96 is positioned such that the prongs 142 each extend through aperture 46 up and into the cavity 42.

More specifically, the prongs 142 each extend through the aperture 46 into the base member cavity 42 and through the post cavity 130. In one embodiment, during insertion into the cavities 42 and/or 130, the prongs 142 slightly deflect toward one another to fit through the aperture 46 and through the post cavity 130. The pin 96 is pushed through the post cavity 130 until the prong teeth 144 are positioned at least slightly above the shoulder 132 of handle 18. When so positioned, the biasing of the prongs 142 overcomes the deformation of the prongs 142 to straighten the prongs 142, thereby, causing the prong teeth 144 to bear against the shoulder 132 of the handle 18. Accordingly, the handle 18 is coupled to the base member 12 with the pin 96. In one embodiment, when the prong teeth 144 bear against the shoulder 132, the plate member 140 bears or nearly bears against a structure forming the base member cavity 42, to substantially maintain the position of handle 18 relative to the base member 12 in a direction substantially parallel to the neck axis N (FIG. 2). With this construction, the mounting assembly 20 allows for rotation of the handle 18, and likely the pin 96, relative to the base member 12. The interfacing of the ridges 90, 92 provides a plurality of rotational orientation positions in which the handle 18 is "locked" relative to the base member 12.

Figure 4:
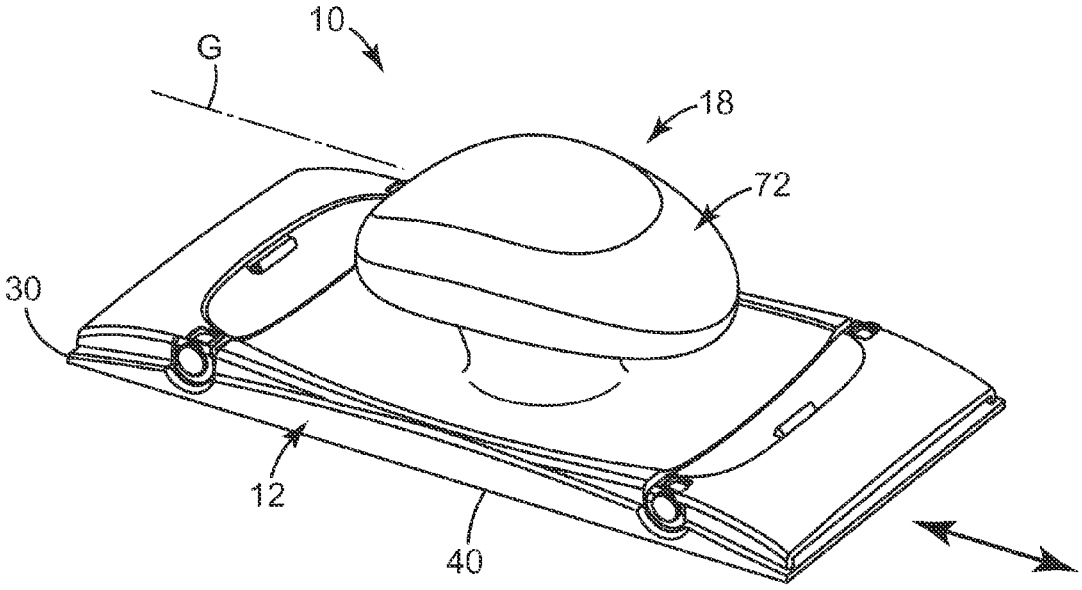
FIG. 4 is a top perspective view of the sanding tool of FIG. 1 with a handle in a first rotational orientation.
Figure 5:
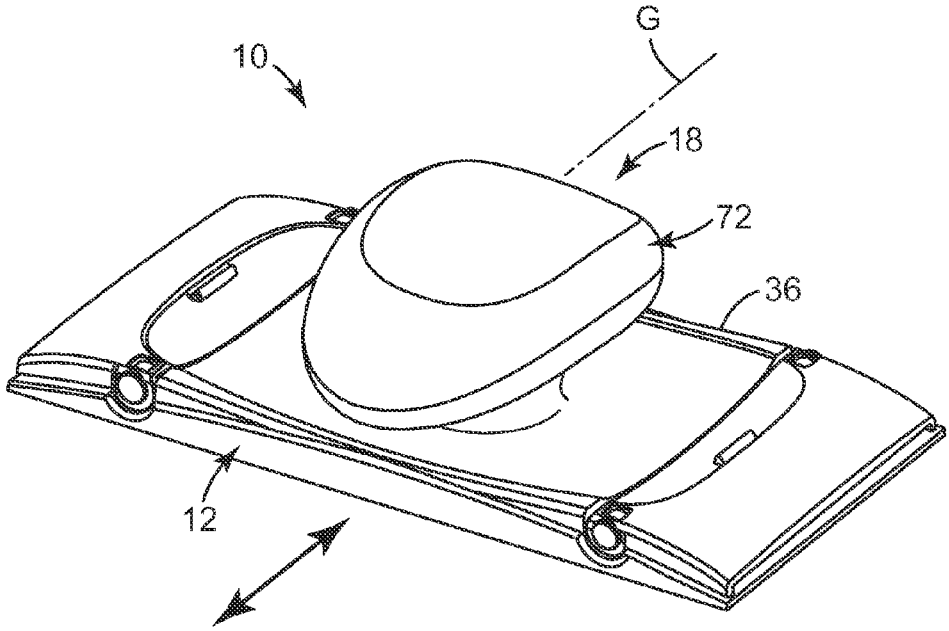
FIG. 5 is a top perspective view of the sanding tool of FIG. 1 with the handle in a second rotational orientation.

Once assembled, the meshed interface between the sets of ridges 90, 92 effectively "locks" the handle 18 in a rotational orientation relative to the base member 12. One such rotational orientation is shown in FIG. 4. More particularly, the handle 18 is rotationally oriented such that the gripping direction/axis G is spatially oriented in a direction of the first end 30 of the base member 12. In this position, a user (not shown) can grasp the grip 72 in his/her hand and perform a sanding operation in which a sheet-like abrasive material (not shown), otherwise secured to the base member 12 and extending along the bottom surface 40, is maneuvered across a working surface to effectuate sanding of the working surface by placement of manual force upon the handle 18. The rotational orientation of the handle 18 in FIG. 4 can, for example, be highly conducive to sanding in a longitudinal direction of the base member 12 (shown by an arrow in FIG. 4).

Where desired, a second rotational orientation of the handle 18 relative to the base member 12 can subsequently be selected. In particular, the handle 18 is rotated relative to the base member 12 about the neck axis N (FIG. 2), resulting, for example, in the rotational handle orientation shown in FIG. 5. To this end, a rotational or moment force can be applied by a user (not shown) on to the grip 72 to effectuate rotation of the handle 18 relative to the base member 12. Returning to FIGS. 1 and 2, as the rotational force is imparted on to the handle 18 (relative to the base member 12), the first set of ridges 90 are forced to disengage from the second set of ridges 92 (i.e., the ridges 110 of the first set 90 dislodge from the corresponding grooves 122, and the ridges 120 of the second set 92 dislodge from the gaps 112, with each ridge 110 effective sliding up and over a corresponding, adjacent of the ridges 120). The tapered end 124 of the ridges 120 facilitates this disengagement, while interface between the post 94 and the shoulder 48 maintains axial alignment between the handle 18 and the base member 12 in the disengaged state of the sets of ridges 90, 92. In addition, the user can apply a pulling force on to the handle 18 and the base member 12 sufficient to cause the sets of ridges 90, 92 (FIGS. 1 and 2) to slightly axially separate from one another, thus making rotational disengagement of the sets of ridges 90, 92 easier. In one embodiment, the pin 96 is configured to slightly flex upward during rotation of the handle 18 to further facilitate disengagement of the sets of ridges 90, 92, thereby, easing rotation of the handle 18.

Regardless, once the handle is rotated to a desired orientation, the sets of ridges 90, 92 again mesh with one another, to effectively "lock" the handle 18 relative to the base member 12 in the selected position. That is to say, rotation of the handle 18 relative to the base member 12 continues until the ridges 110 of the first set 90 are again axially aligned with respective ones of the grooves 122 (and the ridges 120 of the second set 92 are aligned with respective ones of the gaps 112). Once aligned, the pin 96 returns to a non-flexed position to bias the sets of ridges 90, 92 into meshed alignment.

This rotational process is continued/repeated until a desired rotational orientation of the handle 18 relative to the base member 12 is achieved. For example, with the second rotational orientation of FIG. 5, the gripping direction/axis G is spatially oriented in a direction of the second side 36 of the base member 12. This orientation can be conducive, for example, to sanding in a transverse direction of the base member 12 (shown by an arrow in FIG. 5). It will be understood that the available number of "locked" rotational orientations is a function of the number of ridges 110, 120 (FIGS. 1 and 2) provided. Notably, the mounting assembly 20 can assume a number of other configurations that promote rotation of the handle 18 along with, in some embodiments, locking of the handle 18 relative to the base member 12. For example, an end of the neck 18 can form a multi-sided shape (e.g., hexagonal) with the base member 12 forming a similarly shaped aperture; a biasing device biases the neck end into selective engagement with the aperture, with a user being able to overcome this biased engagement to rotate the handle relative to the base member.

Figure 6:
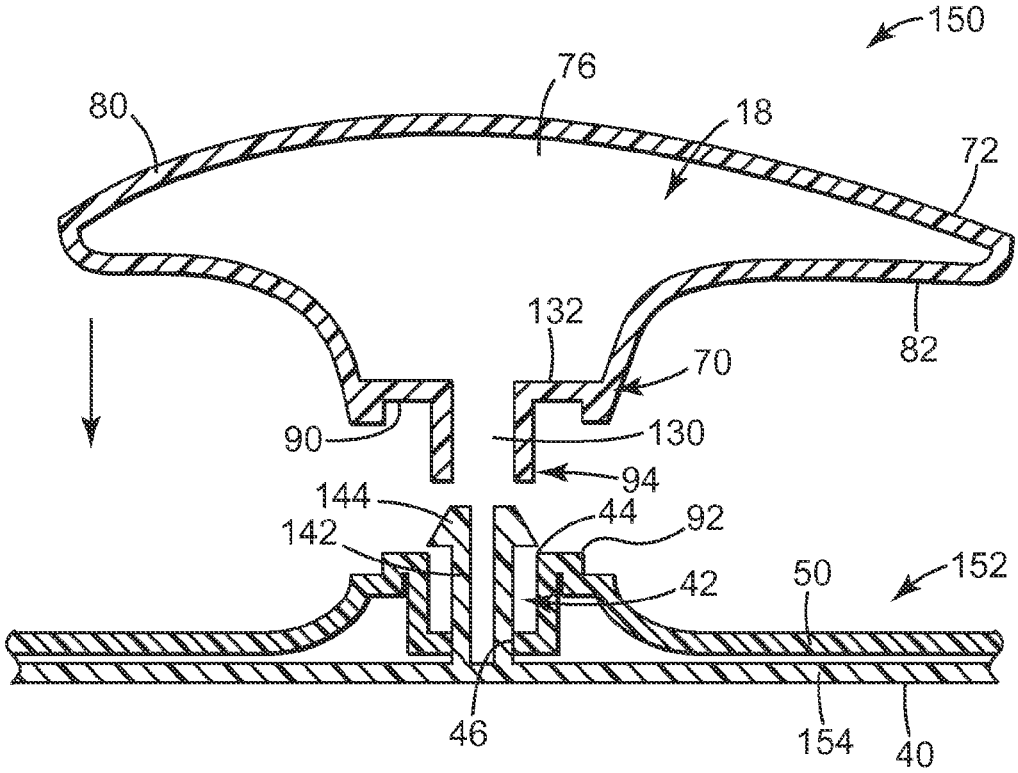
FIG. 6 is a cross-sectional view similar to FIG. 2A of another embodiment of a sanding tool according to principles of the present invention.

The sanding tool 10 described above is but one example of an acceptable configuration in accordance with principles of the present invention. For example, FIG. 6 illustrates another embodiment of a sanding tool 150 similar to sanding tool 10 except for those differences specifically enumerated herein.

The sanding tool 150 includes a base member 152 and the handle 18. Base member 152 is similar to the base member 12 and includes the base body 50 and the support body 154. The support body 154 is similar to the support body 52 described above, but includes prongs 142. More particularly, the prongs 142 extend directly from support body 52 and, therefore, the separate plate member 140 (FIGS. 1 and 3) can be eliminated. As such, the number of parts comprising sanding tool 150 are lessened, which simplifies and lowers the overall cost of manufacture. The sanding tool 150 is assembled and used in similar manners as described above with respect to the sanding tool 10 as will be apparent to one of skill in the art. However, in one embodiment, the handle 18 is rotatable about the stationary prongs 142 included with the support body 154.

Figure 7:
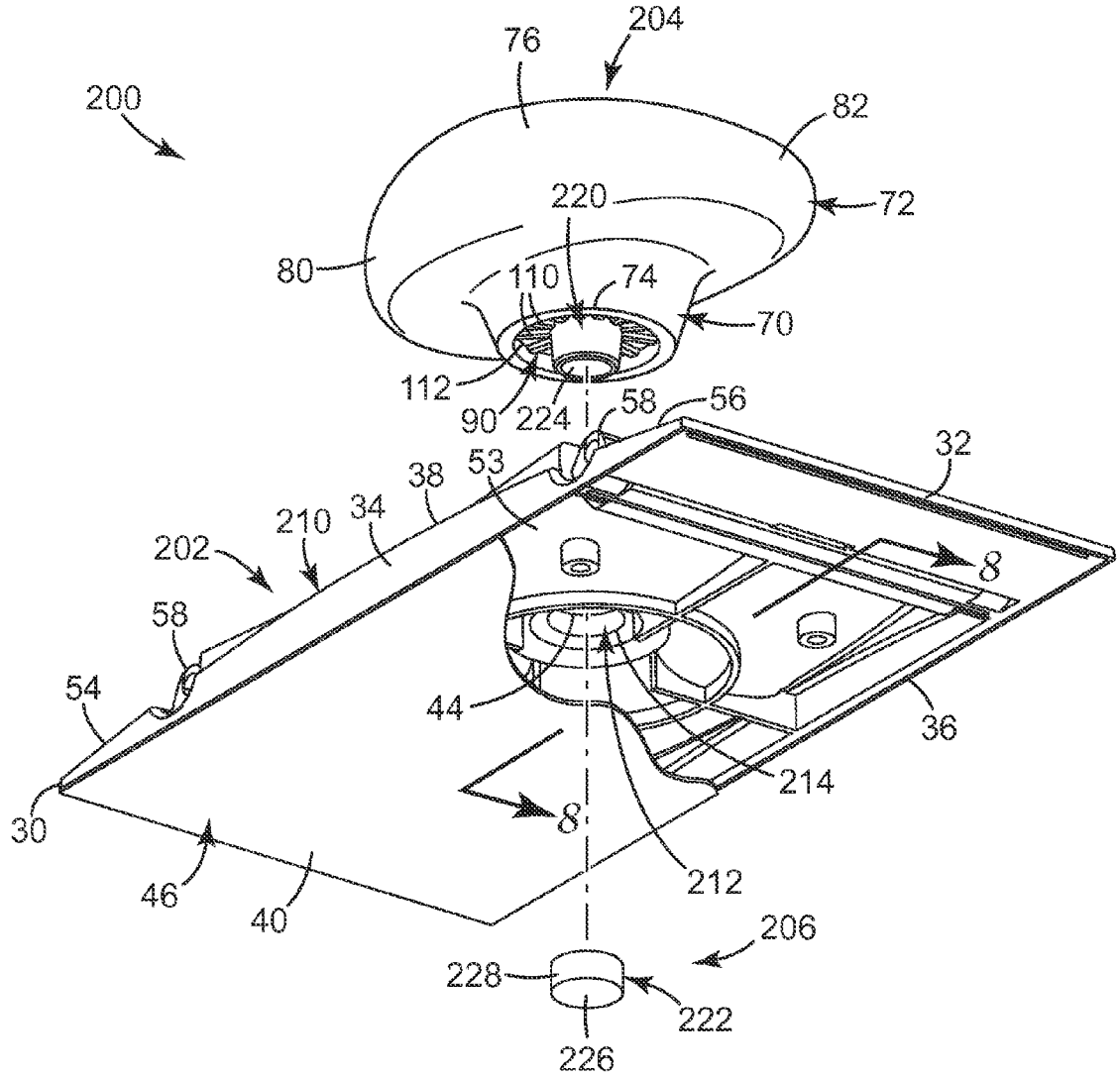
FIG. 7 is a bottom perspective, exploded view of a hand-held, manually-operated sanding tool according to principles of the present invention.
Figure 8:
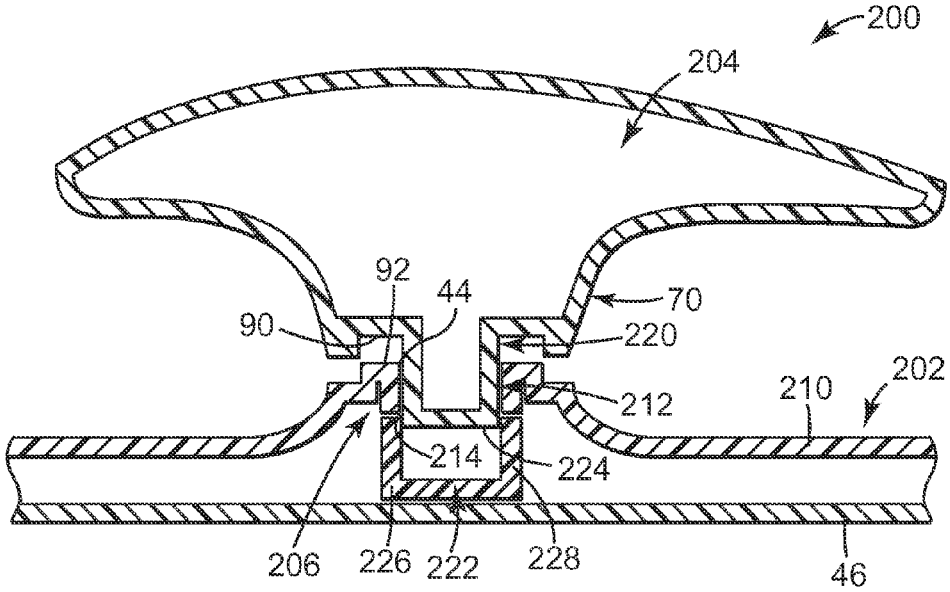
FIG. 8 is a cross-sectional view of one embodiment of the sanding tool FIG. 7 taken along the line 8-8.

FIGS. 7 and 8 illustrate another embodiment of a sanding tool 200 similar to sanding tool 10 of FIGS. 1-5. The sanding tool 200 includes a base member 202, a handle 204, and a mounting assembly 206 (referenced generally in FIG. 7). The sanding tool 200 is similar to the sanding tool 10 except for those differences enumerated herein, within like numbers generally indicating corresponding similar parts. Therefore, the handle 204 is rotatably coupled to the base member 202 by the mounting assembly 206. With this configuration, the handle 204 can be moved to a variety of different rotational orientations relative to the base member 202.

The base member 202 includes a base body 210 and the support body 46. The base body 210 is similar to the base body 50 except that the base body 210 defines a cavity 212 that is substantially cylindrical and open at each end as opposed to the cavity 42 defined above, which forms the smaller diameter aperture 46 (FIG. 3). As such, the cavity 212 is defined by the first open end 44 and a second open end 214.

The mounting assembly 206 includes, in one embodiment, the first set of ridges 90, the second set of ridges 92 (FIG. 2), a post 220, and a coupling device 222. In general, the first set of ridges 90 are associated with the handle 204, whereas the second set of ridges 92 are associated with the base member 202, such that upon assembly of sanding tool 200, the first and second sets of ridges 90, 92 engage one another.

In one embodiment, the post 220 is similar to the post 94 except that instead of defining the open cavity 130 (FIGS. 1-3), the post 220 defines an end cap 224. However, in other embodiments, the end cap 224 may be eliminated. In one embodiment, the coupling device 222 is formed as a cylindrical cap and includes a plate-like member 226 and a side wall 228 circumferentially extending around the plate-like member 226 in one direction. The cylindrical cap 224 is configured to receive and retain a portion of the post 220 extending through second open end 214 of the cavity 212.

The sanding tool 200 is assembled similar to the sanding tool 10. More specifically, the neck 70 of the handle 204 is positioned over the base member 202 such that the post 220 extends through the first cavity opening 44 and the second cavity opening 214. When the post 220 is positioned within the cavity 212, the first and second sets of ridges 90, 92 interface (e.g., mesh) with one another as described above. The cap 224, more particularly the side wall 228, is positioned around the post 220 to secure the post 220 to the base body 210. In one embodiment, the cap 224 is secured to the post 220 by ultrasonic welding, solvent bonding, or any other suitable method. Accordingly, during use, rotation of the handle 204 similarly rotates the cap 224. Once assembled, the sanding tool 200 is used similar to the sanding tool 10 described above.

Figure 9:
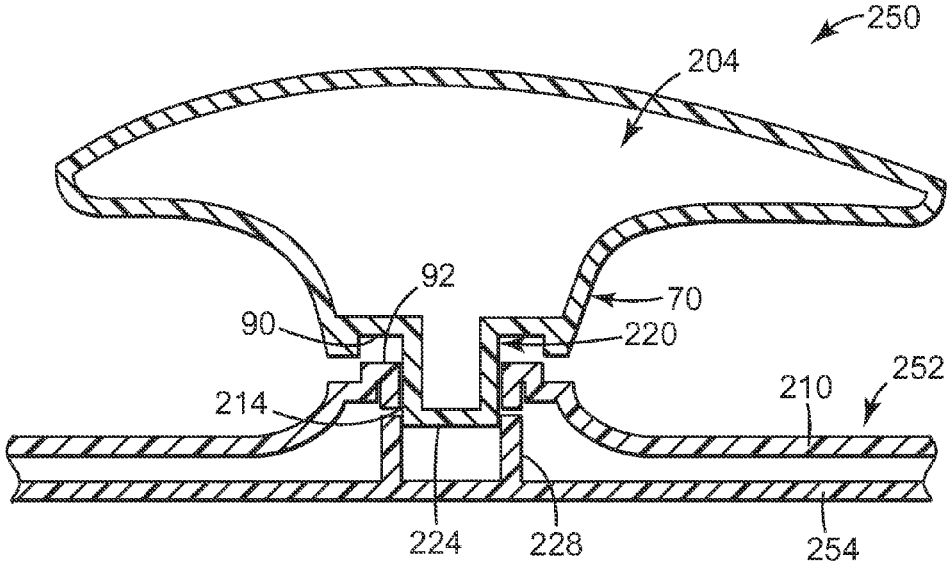
FIG. 9 is a cross-sectional view similar to FIG. 8 of another embodiment a sanding tool according to principles of the present invention.

Yet another embodiment of a sanding tool in accordance with principles of the present invention is illustrated in FIG. 9 generally at 250, which is similar to sanding tool 200 except for those differences specifically enumerated herein. The sanding tool 250 includes a base member 252 and the handle 204. The base member 252 is similar to the base member 202 and includes the base body 210 and a support body 254. The support body 254 is similar to the support body 46 described above, but includes the cylindrical cap side wall 228 extending directly from the interior surface of the planar member of the support body 254. Since the side wall 228 extends directly from support body 254, the separate plate member 224 (FIGS. 1 and 3) can be eliminated, thereby, eliminating the number of parts comprising sanding tool 250, which simplifies and lowers the overall cost of manufacture. The sanding tool 250 is assembled and used in similar manners as described above with respect to the sanding tools 10, 150, and 200 as will be apparent to one of skill in the art. However, in one embodiment, the side wall 228 is not statically secured to the post 220, but rather, the post 220 is configured to rotate relative to the side wall 228 when the handle 204 is rotated.

Figure 10:
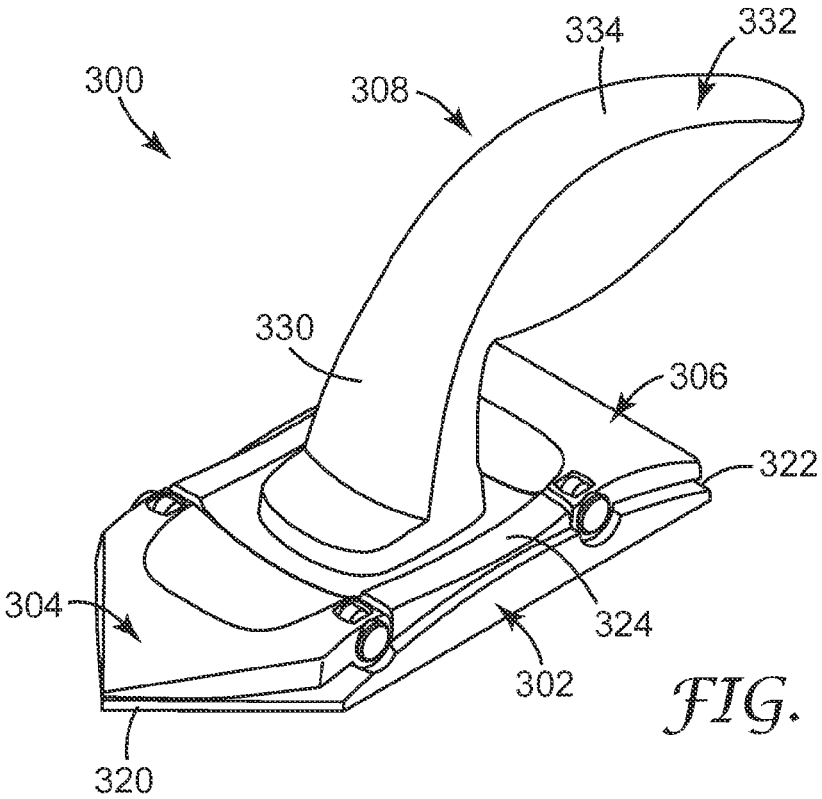
FIG. 10 is a top perspective view of another embodiment hand-held, manually-operated sanding tool according to principles of the present invention, including a handle in a first rotational orientation.
Figure 11:
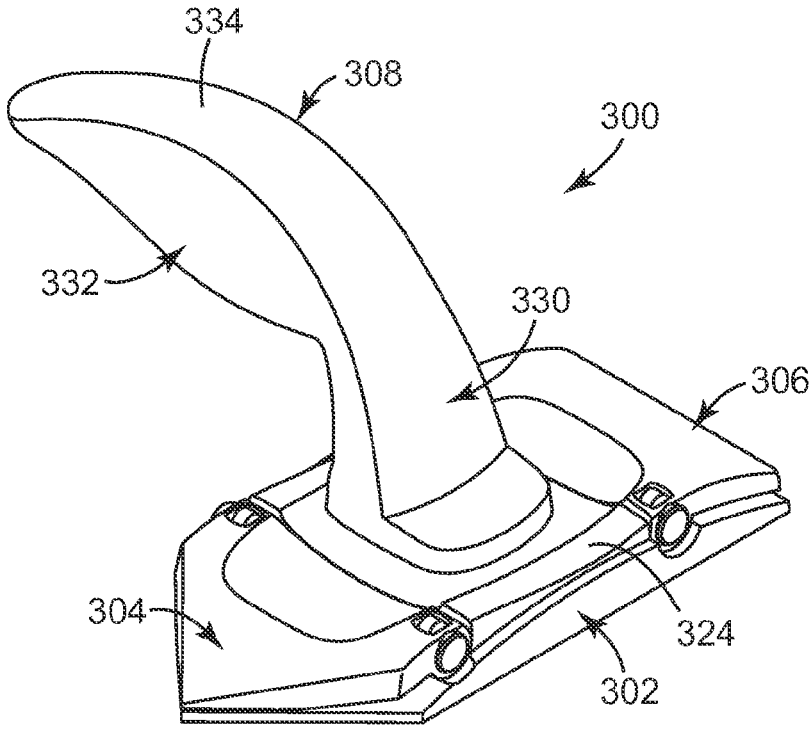
FIG. 11 is a top perspective view of the sanding tool of FIG. 10 with the handle in a second rotational orientation.

Another embodiment of a sanding tool 300 is shown in FIGS. 10 and 11. In basic terms, the sanding tool 300 is highly similar to the sanding tool 10 previously described, and includes a base member 302, clamping mechanisms 304, 306, and a handle 308. The sanding tool 300 further includes a mounting assembly that is hidden in the views of FIGS. 10 and 11, but can assume any of the forms previously described with respect to the mounting assemblies 20, 206 (FIGS. 1-4, 7, and 8). Thus, the mounting assembly rotatably mounts the handle 308 to the base member 302.

With the above general principles in mind, the base member 302 defines first and second ends 320, 322, and a top surface 324. Unlike the base member 12 (FIGS. 1 and 2), with the embodiment of FIGS. 10 and 11, the first and second ends 320, 322 are not identical; the first end 320 has a triangular shape. The first clamping mechanism 304, while generally similar to the clamping mechanisms 14, 16 (FIGS. 1 and 2) previously described, mimics this triangular shape.

The handle 308 again includes a neck 330 and a grip 332, with the grip 332 having a grip surface 334 defining a gripping direction/axis G. A comparison of the handle 308 with the handle 18 (FIGS. 1 and 2) illustrates the wide variety of handle shapes available with the present invention.

The mounting assembly (not shown) rotatably mounts the neck 330 to the top surface 324, preferably in a manner that selectively "locks" the handle 308 relative to the base member 302 at a plurality of rotational orientations of the gripping direction/axis G relative to the base member 302. For example, FIG. 10 illustrates a first rotational orientation, whereas FIG. 11 illustrates a second, different rotational orientation.

The sanding tool in accordance with principles of the present invention provides a marked improvement over previous designs. In particular, the mounting assembly provides a simplified method of assembling the sanding tool. In addition, by providing the sanding tool with a rotatable handle, a user can select, and re-select, an ergonomically-desired rotational orientation of the handle for any particular use. Further, and in accordance with some embodiments, the ability to selectively lock the handle at a desired rotational orientation ensures that an adequate pushing force can be applied by the user.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, individual features of the sanding tools 10, 150, 200, 250, and 300 may be interchanged with one another and/or used in addition to other features of the sanding tools 10, 150, 200, 250, and 300. This application is intended to cover any adaptations or variations of the specific embodiments discussed herein. Therefore, it is intended that this invention be limited only by the claims and the equivalents thereof.

What is claimed is:

1. A method of sanding with a hand-held, manually operated sanding tool, the method comprising:

providing a sanding tool including:

a base body having a lower surface, an upper surface, and a hollow interior therebetween, the base body further defining an aperture extending from the interior through the upper surface of the base body, a handle including a grip and a hollow post extending away from the grip, and a flexible coupling device extending from the interior of the base body through the aperture and through the interior of the post for biasly coupling with the post of the handle to connect the handle to the base body, wherein the handle and the coupling device are positioned in order to rotatably couple the handle to the base body such that the handle is rotatable about an axis defined by the post;

wherein the post and the coupling device are each part of a mounting assembly configured to selectively lock the handle via the post relative to the base body at a plurality of rotational orientations relative to the base body;

providing a replaceable sheet-like abrasive material;

securing the sheet-like abrasive material to the sanding tool such that the sheet-like abrasive material extends across a bottom of the lower surface of the sanding tool;

rotating the handle to a first desired rotational orientation relative to the base body;

locking the handle relative to the base body in the first desired rotational orientation; grasping the grip within a user's hand;

maneuvering the sheet-like abrasive material across a working surface by applying a force to the handle via the user's hand to sand the working surface;

rotating the handle to a second desired rotational orientation differing from the first desired rotational orientation; and sanding the working surface with the handle in the second desired rotational orientation.

2. The method of claim 1, further comprising:

rotating the handle to a third desired rotational orientation differing from the first and second desired rotational orientations; and sanding the working surface with the handle in the third desired rotational orientation.

3. The method of claim 1, wherein the grip defines a major gripping axis, and further wherein a spatial orientation of the gripping axis relative to the base body in the first desired rotational orientation differs from a spatial orientation of the gripping axis relative to the base body in the second desired rotational orientation.

4. The method of claim 1, wherein rotating the handle to a first desired rotational orientation includes the coupling device deforming.

5. The method of claim 1, wherein rotating the handle to a first desired rotational orientation includes the coupling device flexing.

6. The method of claim 1, wherein locking the handle relative to the base body includes the coupling device biasing the handle to a locked position.

* * * * *